US012595599B2

(12) United States Patent
Xu et al.

(10) Patent No.: US 12,595,599 B2
(45) Date of Patent: Apr. 7, 2026

(54) MULTI-COMB JACQUARD THREE-DIMENSIONAL JACQUARD MESH FABRIC AND ITS PREPARATION METHOD

(71) Applicant: SINCETECH (FUJIAN) TECHNOLOGY CO., LTD., Quanzhou (CN)

(72) Inventors: Jintai Xu, Quanzhou (CN); Lian Liu, Quanzhou (CN); Yingdong Zhang, Quanzhou (CN); Xuefang Xie, Quanzhou (CN); Bingbing Xu, Quanzhou (CN); Libing Lin, Quanzhou (CN); Xiaomei Chen, Quanzhou (CN); Yaling Shi, Quanzhou (CN)

(73) Assignee: SINCETECH (FUJIAN) TECHNOLOGY CO., LTD., Quanzhou (CN)

( * ) Notice: Subject to any disclaimer, the term of this patent is extended or adjusted under 35 U.S.C. 154(b) by 0 days.

(21) Appl. No.: 19/031,454

(22) Filed: Jan. 18, 2025

(65) Prior Publication Data

US 2025/0171936 A1 May 29, 2025

Related U.S. Application Data

(63) Continuation of application No. PCT/CN2023/135278, filed on Nov. 30, 2023.

(30) Foreign Application Priority Data

Nov. 27, 2023 (CN) ..... 202311607470.X

(51) Int. Cl.
*D04B 25/12* (2006.01)
*D04B 21/10* (2006.01)

(52) U.S. Cl.
CPC ..... *D04B 25/12* (2013.01); *D04B 21/10* (2013.01); *D10B 2403/021* (2013.01)

(58) Field of Classification Search
CPC ..... D04B 25/10; D04B 25/12; D04B 25/14; D04B 23/22; D04B 23/02
See application file for complete search history.

(56) References Cited

U.S. PATENT DOCUMENTS 5,899,095 A * 5/1999 Spillane ..... D04B 21/08 66/195
6,276,177 B1 * 8/2001 West ..... D04B 23/22 442/306

(Continued)

FOREIGN PATENT DOCUMENTS

CN 107217384 B * 8/2019 ..... D04B 21/06
CN 115710775 A 2/2023

(Continued)

OTHER PUBLICATIONS

Office Action issued in counterpart European Patent Application No. EP 23947811.8, dated Oct. 22, 2025.

(Continued)

*Primary Examiner* — Danny Worrell
(74) *Attorney, Agent, or Firm* — Westbridge IP LLC

(57) ABSTRACT

Disclosed are a multi-comb Jacquard three-dimensional jacquard mesh fabric and its preparation method. The mesh fabric includes a surface layer, a base layer, and a connecting layer. The surface layer is woven with the first warp knitting basic structure, the base layer is woven with the second warp knitting basic structure, and the connecting layer is used to connect the surface layer and the base layer. Among them, the surface layer and/or the base layer is woven with a three-dimensional jacquard pattern, which includes a jacquard profile and jacquard protrusions. The jacquard profile is woven by the Jacquard comb through the second Jacquard (Continued)

basic structure, and the jacquard protrusions are woven by the Jacquard comb through the first Jacquard basic structure.

10 Claims, 4 Drawing Sheets

(56) References Cited

U.S. PATENT DOCUMENTS

| | | | | |
|---|---|---|---|---|
| 6,276,178 | B1 * | 8/2001 | West | D04B 21/10 66/193 |
| 8,448,476 | B2 * | 5/2013 | Lee | D04B 21/10 66/195 |
| 9,677,209 | B2 * | 6/2017 | Daube | D04B 23/02 |
| 2003/0101776 | A1 | 6/2003 | Shirasaki et al. | |
| 2005/0081402 | A1 * | 4/2005 | Orei | A43B 1/028 36/45 |
| 2008/0006060 | A1 * | 1/2008 | Park | F25B 21/04 66/170 |
| 2019/0218694 | A1 * | 7/2019 | Lin | D04B 1/102 |
| 2020/0063301 | A1 * | 2/2020 | Takayama | D04B 21/06 |
| 2025/0171936 | A1 * | 5/2025 | Xu | D04B 21/08 |

FOREIGN PATENT DOCUMENTS

| | | | | |
|---|---|---|---|---|
| CN | 218580218 | U * | 3/2023 | |
| CN | 110685059 | B * | 4/2024 | D04B 1/104 |
| CN | 119083018 | A * | 12/2024 | D02G 3/22 |
| JP | 2006161167 | A * | 6/2006 | D04B 21/08 |
| WO | WO-2018214315 | A1 * | 11/2018 | D04B 21/14 |

OTHER PUBLICATIONS

Supplementary Search Report issued in counterpart European Patent Application No. 23947811.8, dated Oct. 10, 2025.

* cited by examiner

MULTI-COMB JACQUARD THREE-DIMENSIONAL JACQUARD MESH FABRIC AND ITS PREPARATION METHOD

CROSS-REFERENCE TO RELATED APPLICATIONS

This application is a continuation of International Patent Application No. PCT/CN2023/135278, filed on Nov. 30, 2023, which claims priority to Chinese Patent Application No. 202311607470.X, filed on Nov. 27, 2023. All of the aforementioned patent applications are hereby incorporated by reference in their entireties.

TECHNICAL FIELD

This application relates to warp knitting mesh fabrics technical field, particularly to a multi-comb Jacquard three-dimensional jacquard mesh fabric and its preparation method.

BACKGROUND

Sandwich mesh fabric is a type of double needle bed warp knitting mesh fabrics, consisting of a mesh surface, connecting monofilaments, and a flat fabric bottom surface. Due to its three-dimensional mesh structure, it resembles a Western sandwich burger, hence the name sandwich mesh fabric. Typically, the pattern designs on the mesh surface are made using Jacquard weaving, which has the advantage of varied patterns. However, due to the structure being woven with Jacquard combs, the line density on the mesh surface is high, the texture is thick, breathability is poor, and the sense of layering is weak, thus the performance and aesthetic appeal still need further enhancement.

In addition, the sandwich mesh fabrics available in the market are primarily designed with flat, monochrome, or two-color fabric patterns. They are woven using the conventional three-needle loop formation principle of warp-knitted Jacquard technology, which has specific drawbacks: being primarily flat, they can only reflect product characteristics through variations in the size of the fabric mesh holes, the shape of the mesh holes, and the thickness of the structural organization, lacking a three-dimensional appearance.

SUMMARY

Other features and advantages of this application will be elaborated in the subsequent description, and will become apparent either from the description itself or through the implementation of this application. The objectives and other advantages of this application can be realized and obtained through the structures specifically pointed out in the description and other accompanying drawings.

The purpose of this application is to overcome the above shortcomings and provide a multi-comb Jacquard three-dimensional jacquard mesh fabric and its preparation method. This application utilizes the characteristics of high shrinkage rate of high-elastic yarn and low shrinkage rate of low-elastic yarn, using two different Jacquard combs to pad the yarn and follow the basic Jacquard structure, thereby weaving a three-dimensional jacquard pattern, significantly enhancing the three-dimensional effect of the mesh fabric, and making the fabric more delicate and thicker, with strong structural stability.

In the first aspect, this application provides a multi-comb Jacquard three-dimensional jacquard mesh fabric, which includes a mesh fabric body that is integrally woven by a warp knitting machine. The mesh fabric body comprises a surface layer, a base layer woven below the surface layer, and a connecting layer woven between the surface layer and the base layer. The surface layer is woven with the first warp knitting basic structure, the base layer is woven with the second warp knitting basic structure, and the connecting layer is used to connect the surface layer and the base layer.

Among them, the surface layer and/or the base layer are woven with three-dimensional jacquard patterns, which include jacquard profiles and jacquard protrusions. The jacquard profile is woven by the Jacquard comb through the second Jacquard basic structure, while the jacquard protrusion is woven by the Jacquard comb through the first Jacquard basic structure. The jacquard protrusions on the jacquard mesh fabric constitute the first area, while the remainder constitutes the second area. The thickness of the first area is greater than that of the second area, and the first area is woven with jacquard and/or mesh, while the second area is woven with jacquard and/or mesh.

This application utilizes two different Jacquard combs to pad the yarn and employs the basic Jacquard structure, in conjunction with colored yarn and functional yarns, to weave a three-dimensional jacquard pattern, significantly enhancing the three-dimensional effect of the mesh fabric, while also making it more delicate and thicker, with strong structural stability.

In some embodiments, the jacquard profile uses high-elasticity yarn, while the jacquard protrusion uses low elasticity yarn. This application utilizes the characteristics of high shrinkage rate of high-elastic yarn and low shrinkage rate of low elastic yarn to weave low elastic yarn into jacquard protrusions and high elastic yarn into jacquard profiles. Under the effect of the high shrinkage rate of high-elastic yarn, the jacquard profile shrinks while pushing the jacquard protrusions outward, enhancing the three-dimensional protrusion effect of the jacquard protrusions, thereby strengthening the three-dimensional effect of the mesh fabric.

In some embodiments, mesh eyes are woven into the jacquard protrusions. This application weaves several mesh eyes within the jacquard protrusions, significantly enhancing the breathability performance of the mesh fabric.

In some embodiments, mesh eyes are woven within the jacquard protrusions, with the jacquard profile using high-elasticity yarn and the jacquard protrusions using low-elasticity yarn. This application utilizes the characteristics of high shrinkage rate of high-elastic yarn and low shrinkage rate of low elastic yarn to weave low elastic yarn into jacquard protrusions and high elastic yarn into jacquard profiles. Under the effect of the high shrinkage rate of high-elastic yarn, the jacquard profile shrinks while pushing the jacquard protrusions outward, enhancing the three-dimensional protrusion effect of the jacquard protrusions, thereby strengthening the three-dimensional effect of the mesh fabric. Moreover, several mesh eyes are woven within the jacquard protrusions, greatly improving the breathability performance of the mesh fabric.

In some embodiments, the bottom layer is woven with breathing holes. This application weaves several breathing holes in the bottom layer, greatly enhancing the breathability of the mesh fabric.

In some embodiments, the jacquard protrusions in the first area are jacquard protrusions with different luster and brightness, including transparent convex, glossy convex, dull convex, non-glossy convex, or luster degree convex.

In some embodiments, the first Jacquard basic structure is 1-0/1-0/1-2/1-2//, with the basic structure selected from combinations in 0-4.

In some embodiments, when weaving the multi-comb jacquard three-dimensional jacquard mesh fabric, the elastic value of the jacquard mesh fabric is adjusted by selecting different proportions of yarns, which include yarns with elastic properties and non-elastic yarns. The yarn with elastic properties referred to in this application is not limited to the material, processing technology, or structure of the yarn, as long as the corresponding yarn meets the requirements for extensibility or imparts elasticity to the mesh fabric. Common yarns with elastic properties include: Spandex core yarn, semi-gloss environmentally friendly low-elastic lightweight mesh yarn, PTT yarn, biobased elastic yarn, PTT blended yarn, TPEE blended yarn, etc.

In some embodiments, the jacquard protrusions are divided into several protrusion areas, with different thicknesses of jacquard protrusions in different protrusion areas, which can be arranged continuously or intermittently adjacent to each other.

In some embodiments, the jacquard protrusions include at least two colors, divided into first color jacquard protrusions and second color jacquard protrusions, with the multi-comb jacquard three-dimensional jacquard mesh fabric containing the first color jacquard protrusions and second color jacquard protrusions being woven using at least three jacquard combs.

In some embodiments, the thickness variation direction of the protrusion area is: gradually increasing from the inside to the outside or gradually increasing from the outside to the inside, with the thickness variation direction being horizontal and/or vertical.

In some embodiments, the multi-comb jacquard three-dimensional jacquard mesh fabric is made into the upper, and at least one position of the shoe side, shoe opening, and heel is selected to weave yarn with elastic properties.

In some embodiments, the multi-comb jacquard three-dimensional jacquard mesh fabric is made into an upper, and the upper is customized with elastic regions and non-elastic regions by selecting yarns and/or basic organizational structures.

In some embodiments, the multi-comb jacquard three-dimensional jacquard mesh fabric is made into an upper, and a support framework is formed on the upper through jacquard protrusions, which are woven from non-elastic yarn.

In a second aspect, this application provides a preparation method for multi-comb jacquard three-dimensional jacquard mesh fabric, which includes using a double needle bed jacquard warp knitting machine for fabric weaving. The fabric includes a surface layer, a bottom layer woven below the surface layer, and a connection layer woven between the surface layer and the bottom layer. The surface layer is at least woven with one ground comb, which is placed on the front needle bed and follows the first warp knitting basic structure; The bottom layer is at least woven with one ground comb, which is placed on the rear needle bed and follows the second warp knitting basic structure; The connection layer is at least woven with one Jacquard comb or one ground comb, with the Jacquard comb placed on both the front and rear needle beds; Among them, the surface layer and/or the bottom layer is woven with a three-dimensional jacquard texture, which includes jacquard profiles and jacquard protrusions. The jacquard profile is at least woven with one Jacquard comb, which is placed on the front and/or rear needle beds and follows the first Jacquard basic structure; The Jacquard protrusion is formed by at least one Jacquard combing, where the Jacquard combing lays yarn on the front needle bed and/or the rear needle bed while following the second Jacquard basic structure.

This application utilizes the warp knitted sandwich mesh fabric produced by the currently equipped double needle bed Jacquard warp knitting machine. Through reasonable process design of the Jacquard pattern area, it fully leverages the unique properties of the shrinkage ratios of elastic property yarns, low elasticity yarns, or inelastic yarns, along with the unique advantages of the double needle bed Jacquard warp knitting machine. It combines the variations of combing empty pass yarns and the precise design of pattern design with the use of chemical fiber yarns to produce high-performance sandwich mesh fabric with a unique appearance and excellent three-dimensional effect.

In some embodiments, the first Jacquard basic structure is 1-0/1-0/1-2/1-2//, with the basic structure selected from combinations in 0-4.

In some embodiments, the basic structure of the second Jacquard is 1-0/1-1/1-2/1-1// or 1-1/1-2/1-1/1-0//, with the basic structure selected from combinations in 0-4.

In this application, the first Jacquard basic structure and the second Jacquard basic structure are not limited to the aforementioned types; using these types as examples, the basic structure can be any combination from 0-4.

By adopting the aforementioned technical solution, the beneficial effects of this application are as follows.

The multi-comb Jacquard three-dimensional jacquard mesh fabric in this application can achieve elastic customization, customizable jacquard protrusion height, arbitrary setting of jacquard structures in the protrusion area and free openings, as well as arbitrary setting of jacquard structures and free openings in non-protrusion areas. For instance, when the jacquard mesh fabric is made into an upper, it greatly enriches the style and functionality of the upper.

This application utilizes the warp knitted sandwich mesh fabric produced by the currently equipped double needle bed Jacquard warp knitting machine. Through reasonable process design of the Jacquard pattern area, it fully leverages the unique properties of functional yarn and the distinctive advantages of the double needle bed Jacquard warp knitting machine, combined with the variations of combing empty pass yarns, as well as the precise design of pattern and the use of chemical fiber yarn, to produce a high-performance sandwich mesh fabric with a unique appearance and excellent three-dimensional effect.

The sandwich mesh fabric in this application is made from a mesh fabric body that is integrally knitted by the warp knitting machine. The mesh fabric body includes a surface layer, a connection layer, and a bottom layer, with three-dimensional jacquard textures knitted on the surface layer and/or bottom layer. The three-dimensional jacquard textures include jacquard profiles and jacquard protrusions, and within the jacquard protrusions, several mesh eyes are knitted, providing beneficial effects such as good breathability, wrinkle resistance, shape retention, a strong sense of delicacy, and a strong three-dimensional feel. The overall unique jacquard effect design of the mesh fabric is more exquisite and lightweight, highlighting the layered aesthetic of the jacquard textures, making the overall three-dimensional spatial layers of the mesh fabric more distinct. The functional effects of special yarns further enhance the sense of hierarchy, three-dimensionality, and technological feel, breaking through the current market limitations of mesh fabrics.

It should be understood that the above general description and the detailed description that follows are merely exemplary and explanatory and do not limit the disclosure.

Undoubtedly, the purposes of this application, along with other purposes, will become more apparent after the detailed description of the preferred embodiments illustrated in various figures and drawings below.

In order to make the above and other purposes, features, and advantages of this application more apparent and understandable, one or more preferred embodiments will be specifically described below, along with the accompanying figures.

BRIEF DESCRIPTION OF THE DRAWINGS

The figures are intended to provide further understanding of this application and constitute a part of the specification, used together with the embodiments of this application to explain the application, and do not limit the application.

In the illustrations, the same components are designated by the same reference numerals, and the illustrations are schematic and not necessarily drawn to scale.

In order to more clearly illustrate the technical solutions of the embodiments of this application or the prior art, a brief introduction to the illustrations used in the descriptions of the embodiments or prior art will be provided below. It is evident that the illustrations described below are merely one or several embodiments of this application, and for those skilled in the art, other illustrations can be obtained based on such illustrations without creative effort.

Figure 1:
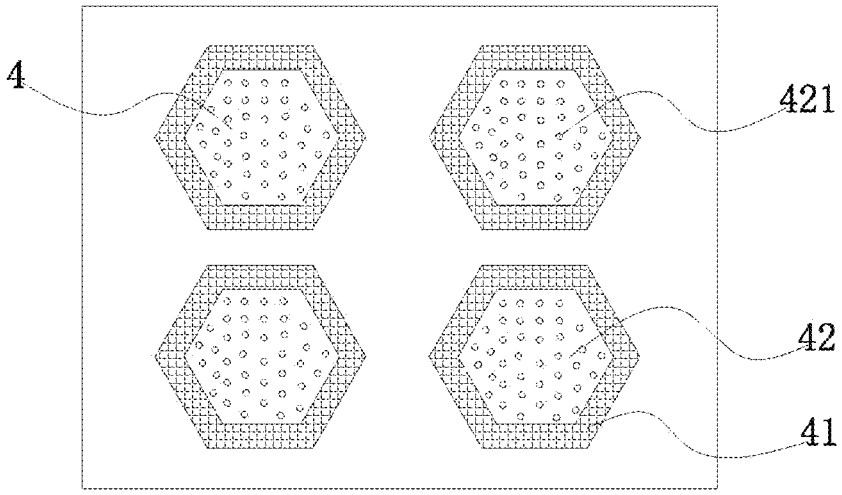

FIG. 1 is a schematic diagram of the structure of a multi-comb jacquard three-dimensional jacquard mesh fabric according to some embodiments of this application.

Figure 2:
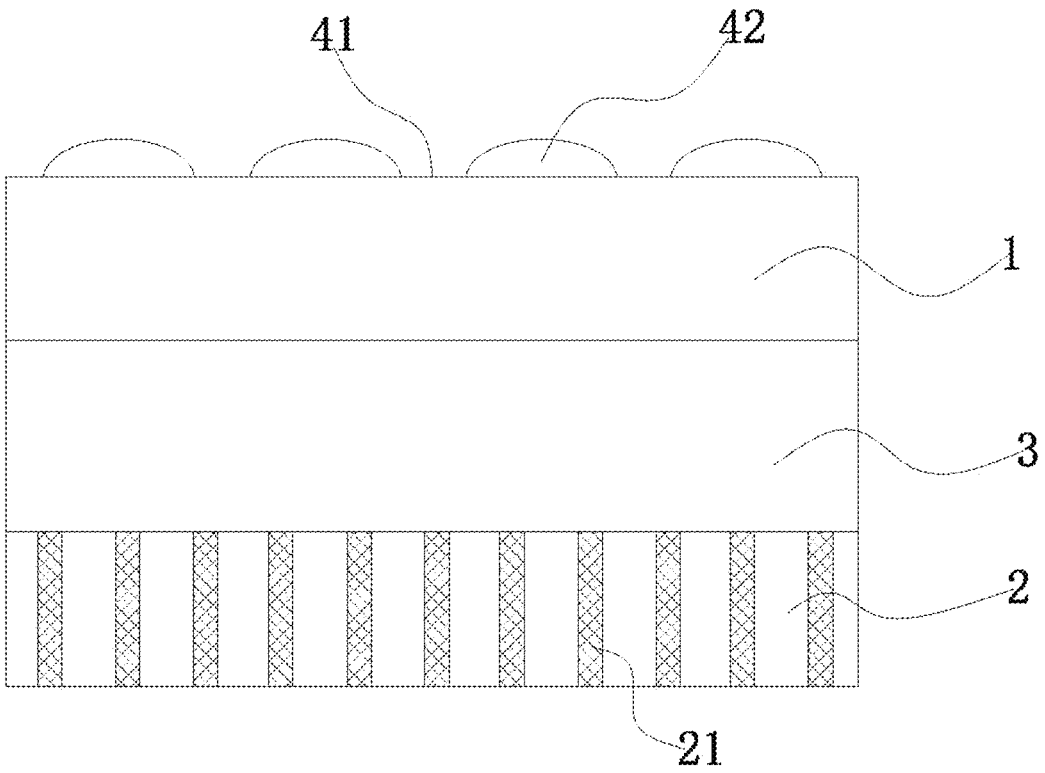

FIG. 2 is a schematic diagram of the structure of a multi-comb jacquard three-dimensional jacquard mesh fabric according to some embodiments of this application.

Figure 3:
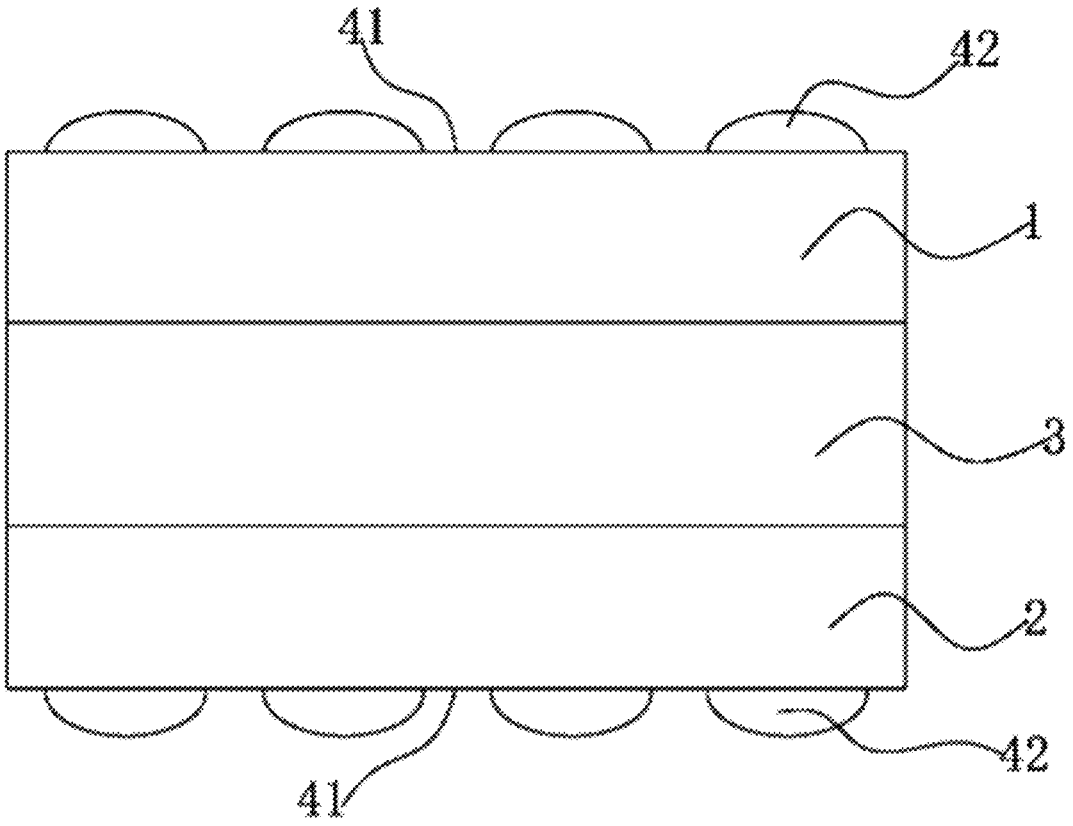

FIG. 3 is a cross-sectional view of a multi-comb jacquard three-dimensional jacquard mesh fabric according to some embodiments of this application.

Figure 4:
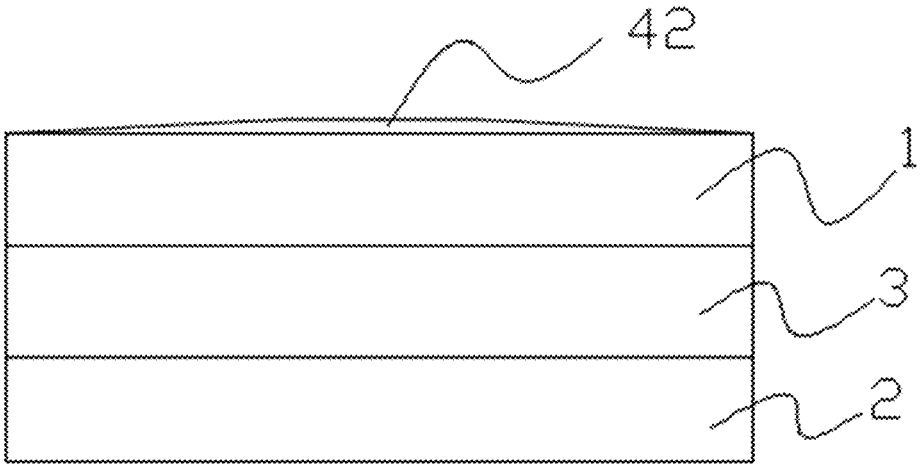

FIG. 4 is a cross-sectional view of a multi-comb jacquard three-dimensional jacquard mesh fabric according to some embodiments of this application.

Figure 5:
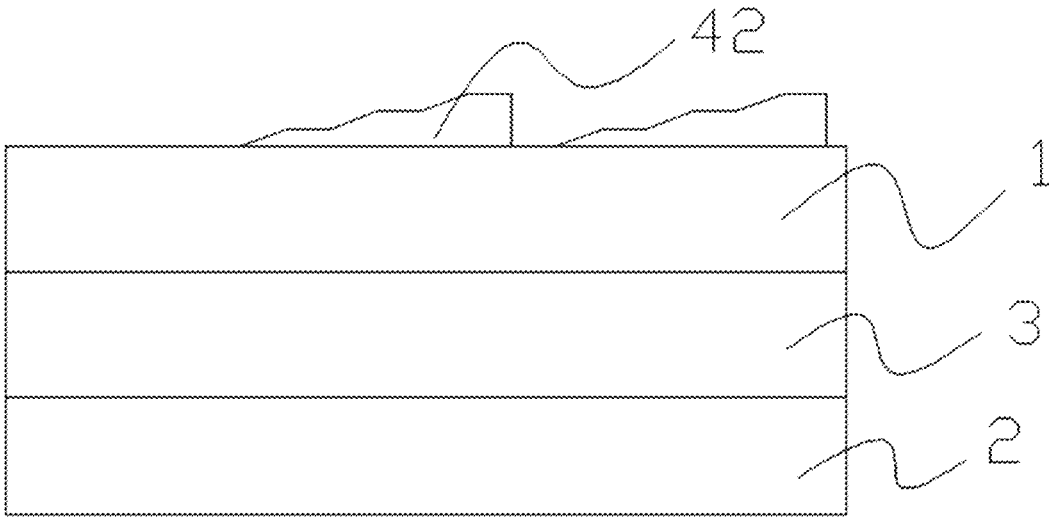

FIG. 5 is a cross-sectional view of a multi-comb jacquard three-dimensional jacquard mesh fabric according to some embodiments of this application.

DETAILED DESCRIPTION OF THE EMBODIMENTS

The following will detail the implementation methods of this application in conjunction with the illustrations, thereby providing a comprehensive understanding of how this application utilizes technical means to solve technical problems and achieve the realization process of technical effects. It should be noted that as long as there is no conflict, various embodiments in this application and the features within each embodiment can be combined, and the resulting technical solutions are all within the protection scope of this application.

At the same time, many specific details are elaborated in the following description for the purpose of explanation, to provide a thorough understanding of the embodiments of this application. However, it is evident to those skilled in the art that this application can be implemented without the specific details or particular methods described herein.

According to some embodiments of this application, with reference to FIGS. 1-5, this application provides a multi-comb jacquard three-dimensional jacquard mesh fabric, which includes a mesh fabric body integrally knitted by a warp knitting machine. The mesh fabric body comprises a surface layer 1, a bottom layer 2 knitted below the surface layer 1, and a connection layer 3 knitted between the surface layer 1 and the bottom layer 2. The surface layer 1 is knitted with the first warp knitting basic structure, the bottom layer 2 is knitted with the second warp knitting basic structure, and the connection layer 3 is used to connect the surface layer 1 and the bottom layer 2; In which, the surface layer 1 and/or the bottom layer 2 are woven with a three-dimensional jacquard texture 4, the three-dimensional jacquard texture 4 includes jacquard profile 41 and jacquard protrusion 42, the jacquard profile 41 is woven by jacquard combing through the second jacquard basic structure, and the jacquard protrusion 42 is woven by jacquard combing through the first jacquard basic structure. The jacquard mesh fabric has jacquard protrusion 42 as the first area, while the rest is the second area. The thickness of the first area is greater than that of the second area, and the first area is woven with jacquard and/or mesh eye 421, while the second area is woven with jacquard and/or mesh eye 421.

This application utilizes two different Jacquard combing pads and follows the Jacquard basic structure, in conjunction with colored yarn and functional yarn, to weave a three-dimensional jacquard texture 4, significantly enhancing the three-dimensional effect of the mesh fabric, making it more delicate and thicker, with strong structural stability.

According to some embodiments of this application, optionally, the surface layer 1 is woven with a three-dimensional jacquard texture 4, which includes a jacquard profile 41 and a jacquard protrusion 42. The jacquard profile 41 is woven by the Jacquard combing through the first Jacquard basic structure, while the jacquard protrusion 42 is woven by the Jacquard combing through the second Jacquard basic structure. This application weaves a three-dimensional jacquard texture 4 with jacquard protrusions 42 and jacquard profiles 41 on the surface layer 1, significantly enhancing the visual perception of the three-dimensional effect on the mesh fabric surface, and greatly improving its aesthetic appeal.

According to some embodiments of this application, optionally, the bottom layer 2 is woven with a three-dimensional jacquard texture 4, which includes jacquard profiles 41 and jacquard protrusions 42. The jacquard profile 41 is woven by jacquard combing through the first jacquard basic structure, while the jacquard protrusion 42 is woven by jacquard combing through the second jacquard basic structure. This application weaves a three-dimensional jacquard texture 4 with jacquard protrusions 42 and jacquard profiles 41 on the bottom layer 2, allowing the inner surface of the mesh fabric to have three-dimensional protrusions. When the mesh fabric contacts the skin, it can provide a massage effect, and the inner surface of the mesh fabric only partially contacts the skin, which can prevent phenomena such as friction or adhesion that may occur when the mesh fabric completely contacts the skin.

According to some embodiments of this application, optionally, both the surface layer 1 and the bottom layer 2 are woven with a three-dimensional jacquard texture 4, which includes jacquard profiles 41 and jacquard protrusions 42. The jacquard profile 41 is woven by jacquard combing through the first jacquard basic structure, while the jacquard protrusion 42 is woven by jacquard combing through the second jacquard basic structure. This application achieves a double-sided mesh fabric with a concave-convex feel by weaving a three-dimensional jacquard texture 4 on the surface of the surface layer 1 and the bottom layer 2, thereby realizing multiple functions.

According to some embodiments of this application, optionally, the jacquard profile 41 uses high-elasticity yarn, while the jacquard protrusion 42 uses low-elasticity yarn. This application utilizes the characteristics of high shrinkage rate of high-elastic yarn and low shrinkage rate of low-elastic yarn to weave the jacquard protrusion 42 with low-elastic yarn and the jacquard profile 41 with high-elastic yarn. Under the action of the high shrinkage rate of the high-elastic yarn, while the jacquard profile 41 shrinks, it pushes the jacquard protrusion 42 outward, enhancing the three-dimensional protrusion effect of the jacquard protrusion 42, thereby strengthening the three-dimensional effect of the mesh fabric.

Both high-elastic yarn and low-elastic yarn belong to the category of elastic yarn. Elastic yarn is a type of filament yarn or short staple yarn that possesses high elastic elongation and rapid recovery capability, and it is a form of expanded yarn. It can be classified into high-elastic yarn and low-elastic yarn based on the degree of elastic elongation. Among them, high-elastic yarn has an elastic elongation of approximately 30%-50%, produced from thermoplastic filaments through heat setting and false twist deformation or knife-edge curling deformation, as well as filament yarns composed of spandex elastic filaments combined with other filaments, and spandex core yarn or spandex-covered yarn used in the warp knitting industry, along with modified spring appearance properties of physical elastic yarns, etc.; The elastic elongation of low elastic yarn is approximately 10%-30%, with filament yarn obtained through a second heat setting process using high-elastic yarn, core-spun yarn made with spandex elastic filaments, and blended short fiber yarn mixed with elastic fibers.

According to some embodiments of this application, optionally, mesh eyes 421 are woven into the Jacquard protrusion 42. This application weaves several mesh eyes 421 into the Jacquard protrusion 42, significantly enhancing the breathability performance of the mesh fabric.

According to some embodiments of this application, optionally, mesh eyes 421 are woven into the Jacquard protrusion 42, the Jacquard profile 41 uses high-elasticity yarn, and the Jacquard protrusion 42 uses low-elasticity yarn. This application utilizes the characteristics of high shrinkage rate of high-elastic yarn and low shrinkage rate of low-elastic yarn to weave the jacquard protrusion 42 with low-elastic yarn and the jacquard profile 41 with high-elastic yarn. Under the action of the high shrinkage rate of the high-elastic yarn, while the jacquard profile 41 shrinks, it pushes the jacquard protrusion 42 outward, enhancing the three-dimensional protrusion effect of the jacquard protrusion 42, thereby strengthening the three-dimensional effect of the mesh fabric. Moreover, several mesh eyes 421 are woven within the jacquard protrusion 42, significantly enhancing the breathability performance of the mesh fabric.

According to some embodiments of this application, optionally, the bottom layer 2 is woven with breathing holes 21. This application weaves several breathing holes 21 in the bottom layer 2, greatly enhancing the breathability of the mesh fabric.

According to some embodiments of this application, optionally, the jacquard protrusions in the first area have different luster and brightness, including transparent convex, glossy convex, dull convex, non-glossy convex, or luster degree convex.

According to some embodiments of this application, optionally, the first Jacquard basic structure is 1-0/1-0/1-2/1-2//, with the basic structure selected from combinations in 0-4.

According to some embodiments of this application, optionally, the elasticity value of the jacquard mesh fabric can be adjusted during the weaving of the multi-comb jacquard three-dimensional jacquard mesh fabric by selecting different proportions of yarns, which include yarns with elastic properties and yarns without elastic properties. The yarn with elastic properties referred to in this application is not limited to the material, processing technology, or structure of the yarn, as long as the corresponding yarn meets the requirements for extensibility or imparts elasticity to the mesh fabric. Common yarns with elastic properties include: Spandex core yarn, semi-gloss environmentally friendly low-elastic lightweight mesh yarn, PTT yarn, biobased elastic yarn, PTT blended yarn, TPEE blended yarn, etc.

According to some embodiments of this application, optionally, the jacquard protrusion 42 is divided into several protrusion areas, with different thicknesses of the jacquard protrusion 42 in different protrusion areas, which are arranged either continuously adjacent or spaced apart.

According to some embodiments of this application, optionally, the jacquard protrusion 42 includes at least two colors, divided into first color jacquard protrusion and second color jacquard protrusion, and the multi-comb jacquard three-dimensional jacquard mesh fabric containing the first color jacquard protrusion and the second color jacquard protrusion is woven using at least three jacquard combs.

According to some embodiments of this application, optionally, the thickness variation direction of the protrusion area is: gradually increasing from the inside to the outside or gradually increasing from the outside to the inside, with the thickness variation direction being horizontal and/or vertical.

According to some embodiments of this application, optionally, the multi-comb jacquard three-dimensional jacquard mesh fabric is made into the upper, and at least one position of the shoe side, shoe opening, and heel is selected to weave yarn with elastic properties.

According to some embodiments of this application, optionally, the multi-comb jacquard three-dimensional jacquard mesh fabric is made into an upper, and the upper is customized with elastic regions and non-elastic regions by selecting yarn and/or basic organizational structure.

According to some embodiments of this application, optionally, the multi-comb jacquard three-dimensional jacquard mesh fabric is made into an upper, and a support framework is formed on the upper by jacquard protrusions 42, which is woven from non-elastic yarn.

According to some embodiments of this application, a multi-comb jacquard three-dimensional jacquard mesh fabric and its preparation method are provided, including using a double needle bed jacquard warp knitting machine for fabric weaving, where the fabric includes a surface layer 1, a bottom layer 2 woven below the surface layer 1, and a connection layer 3 woven between the surface layer 1 and the bottom layer 2. The surface layer 1 is at least woven with one ground comb, and the ground comb lays yarn on the front needle bed while following the first warp knitting basic structure; The bottom layer 2 is at least woven with one ground comb, and the ground comb lays yarn on the rear needle bed while following the second warp knitting basic structure; The connection layer 3 is at least woven with one Jacquard comb or one ground comb, with the Jacquard comb laying yarn on both the front and rear needle beds; Among them, the surface layer 1 and/or the bottom layer 2 are woven with three-dimensional jacquard texture 4, which includes jacquard profile 41 and jacquard protrusion 42. The jacquard profile 41 is at least woven with one Jacquard comb, which lays yarn on the front needle bed and/or the rear needle bed while following the first Jacquard basic structure; The jacquard protrusion 42 is at least woven with one jacquard comb, and the jacquard comb lays yarn on the front needle bed and follows the second jacquard basic structure.

This application utilizes the warp knitted sandwich mesh fabric produced by the currently equipped double needle bed Jacquard warp knitting machine. Through reasonable process design of the Jacquard pattern area, it fully leverages the unique properties of the shrinkage ratios of elastic property yarns, low elasticity yarns, or inelastic yarns, along with the unique advantages of the double needle bed Jacquard warp knitting machine. It combines the variations of combing empty pass yarns and the precise design of pattern design with the use of chemical fiber yarns to produce high-performance sandwich mesh fabric with a unique appearance and excellent three-dimensional effect.

According to some embodiments of this application, optionally, the surface layer 1 is woven with a three-dimensional jacquard texture 4, which includes the jacquard profile 41 and the jacquard protrusion 42. The jacquard profile 41 is at least woven with one jacquard comb, and the jacquard comb lays yarn on the front needle bed and follows the first jacquard basic structure; The jacquard protrusion 42 is at least woven using one jacquard comb, which is placed on the front needle bed and follows the second jacquard basic structure. This application weaves a three-dimensional jacquard texture 4 with jacquard protrusions 42 and jacquard profiles 41 on the surface layer 1, significantly enhancing the visual perception of the three-dimensional effect on the mesh fabric surface, and greatly improving its aesthetic appeal.

According to some embodiments of this application, optionally, the bottom layer 2 is woven with a three-dimensional jacquard texture 4, which includes the jacquard profile 41 and the jacquard protrusion 42. The jacquard profile 41 is at least woven using one jacquard comb, which is placed on the rear needle bed and follows the first jacquard basic structure; The jacquard protrusion 42 is at least woven using one jacquard comb, which is placed on the rear needle bed and follows the second jacquard basic structure. This application weaves a three-dimensional jacquard texture 4 with jacquard protrusions 42 and jacquard profiles 41 on the bottom layer 2, allowing the inner surface of the mesh fabric to have three-dimensional protrusions. When the mesh fabric contacts the skin, it can provide a massage effect, and the inner surface of the mesh fabric only partially contacts the skin, which can prevent phenomena such as friction or adhesion that may occur when the mesh fabric completely contacts the skin.

According to some embodiments of this application, optionally, the surface layer 1 and the bottom layer 2 are woven with a three-dimensional jacquard texture 4, which includes the jacquard profile 41 and the jacquard protrusion 42. The jacquard profile 41 is at least woven using one jacquard comb, which is placed on the front needle bed and rear needle bed and follows the first jacquard basic structure; The Jacquard protrusion 42 is at least woven using a Jacquard combing, which lays yarn on the front needle bed and rear needle bed while following the Second Jacquard Basic Structure. This application achieves a double-sided mesh fabric with a concave-convex feel by weaving a three-dimensional jacquard texture 4 on the surface of the surface layer 1 and the bottom layer 2, thereby realizing multiple functions.

According to some embodiments of this application, optionally, the Jacquard profile 41 uses high-elasticity yarn, while the Jacquard protrusion 42 uses low-elasticity yarn. This application utilizes the characteristics of high shrinkage rate of high-elastic yarn and low shrinkage rate of low-elastic yarn to weave the jacquard protrusion 42 with low-elastic yarn and the jacquard profile 41 with high-elastic yarn. Under the action of the high shrinkage rate of the high-elastic yarn, while the jacquard profile 41 shrinks, it pushes the jacquard protrusion 42 outward, enhancing the three-dimensional protrusion effect of the jacquard protrusion 42, thereby strengthening the three-dimensional effect of the mesh fabric.

Both high-elastic yarn and low-elastic yarn belong to the category of elastic yarn. Elastic yarn is a type of filament yarn or short staple yarn that possesses high elastic elongation and rapid recovery capability, and it is a form of expanded yarn. It can be classified into high-elastic yarn and low-elastic yarn based on the degree of elastic elongation. Wherein, the elastic elongation of high-elastic yarn is approximately 30%-50%, and the filament yarn is produced from thermoplastic filaments through heat setting and false twist deformation or knife-edge curling deformation, as well as composite yarns made from spandex elastic filaments and other filaments. The elastic elongation of low elastic yarn is approximately 10%-30%, with filament yarn obtained through a second heat setting process using high-elastic yarn, core-spun yarn made with spandex elastic filaments, and blended short fiber yarn mixed with elastic fibers.

According to some embodiments of this application, optionally, the Jacquard protrusion 42 is woven with mesh eye 421. This application weaves several mesh eyes 421 into the Jacquard protrusion 42, significantly enhancing the breathability performance of the mesh fabric.

According to some embodiments of this application, optionally, the Jacquard protrusion 42 is woven with mesh eye 421, the Jacquard profile 41 uses high-elasticity yarn, and the Jacquard protrusion 42 uses low-elasticity yarn. This application utilizes the characteristics of high shrinkage rate of high-elastic yarn and low shrinkage rate of low-elastic yarn to weave the jacquard protrusion 42 with low-elastic yarn and the jacquard profile 41 with high-elastic yarn. Under the action of the high shrinkage rate of the high-elastic yarn, while the jacquard profile 41 shrinks, it pushes the jacquard protrusion 42 outward, enhancing the three-dimensional protrusion effect of the jacquard protrusion 42, thereby strengthening the three-dimensional effect of the mesh fabric. Moreover, several mesh eyes 421 are woven within the jacquard protrusion 42, significantly enhancing the breathability performance of the mesh fabric.

According to some embodiments of this application, optionally, the bottom layer 2 is woven with breathing holes 21. This application weaves several breathing holes 21 in the bottom layer 2, greatly enhancing the breathability of the mesh fabric.

According to some embodiments of this application, optionally, the jacquard protrusions in the first area have different luster and brightness, including transparent convex, glossy convex, dull convex, non-glossy convex, or luster degree convex.

According to some embodiments of this application, optionally, the first Jacquard basic structure is 1-0/1-0/1-2/1-2//, with the basic structure selected from combinations in 0-4.

According to some embodiments of this application, optionally, the second Jacquard basic structure is 1-0/1-1/1-2/1-1// or 1-1/1-2/1-1/1-0//, with the basic structure selected from combinations in 0-4.

In this application, the first Jacquard basic structure and the second Jacquard basic structure are not limited to the aforementioned types; the examples provided are merely illustrative, and the basic structures can be any combination of 0-4.

According to some embodiments of this application, a multi-comb Jacquard three-dimensional jacquard mesh fabric is provided, which includes a mesh fabric body integrally knitted by a warp knitting machine. This mesh fabric body comprises a surface layer 1, a bottom layer 2 knitted below the surface layer 1, and a connection layer 3 knitted between the surface layer 1 and the bottom layer 2. The surface layer 1 is knitted with the first warp knitting basic structure, the bottom layer 2 is knitted with the second warp knitting basic structure, and the connection layer 3 is used to connect the surface layer 1 and the bottom layer 2. In this case, the surface layer 1 is woven with a three-dimensional jacquard texture 4, which includes a jacquard profile 41 and a jacquard protrusion 42. The jacquard profile 41 is made of high-elastic yarn woven by the Jacquard combing through the first Jacquard basic structure 1-0/1-0/1-2/1-2//, while the jacquard protrusion 42 is made of low elastic yarn woven by the Jacquard combing through the second Jacquard basic structure 1-0/1-1/1-2/1-1// or 1-1/1-2/1-1/1-0//.

According to some embodiments of this application, a preparation method for a multi-comb jacquard three-dimensional jacquard mesh fabric is provided, which includes using a double needle bed Jacquard warp knitting machine for mesh fabric weaving. The mesh fabric includes a surface layer 1, a bottom layer 2 woven below the surface layer 1, and a connection layer 3 woven between the surface layer 1 and the bottom layer 2. The surface layer 1 is woven using at least one ground comb, which is placed on the front needle bed and follows the first warp knitting basic structure; The bottom layer 2 is woven using at least one ground comb, which is placed on the rear needle bed and follows the second warp knitting basic structure; The connection layer 3 is woven using at least one jacquard comb, which is placed on both the front and rear needle beds; Among them, the surface layer 1 and/or the bottom layer 2 is woven with a three-dimensional jacquard texture 4, which includes jacquard profile 41 and jacquard protrusion 42. The jacquard profile 41 is woven using at least one jacquard comb, which is placed on the front needle bed and/or the rear needle bed and follows the first jacquard basic structure; The jacquard protrusion 42 is at least woven using one jacquard comb, which is placed on the front needle bed and/or the rear needle bed, and follows the second jacquard basic structure.

Embodiment 1

This embodiment provides a multi-comb jacquard three-dimensional jacquard mesh fabric, including a mesh fabric body that is integrally woven by a warp knitting machine. The mesh fabric body comprises a surface layer 1, a bottom layer 2 woven below the surface layer 1, and a connection layer 3 woven between the surface layer 1 and the bottom layer 2. The surface layer 1 is knitted with the first warp knitting basic structure, the bottom layer 2 is knitted with the second warp knitting basic structure, and the connection layer 3 is used to connect the surface layer 1 and the bottom layer 2. Wherein, the surface layer 1 is woven with a three-dimensional jacquard texture 4, which includes a jacquard profile 41 and a jacquard protrusion 42. The jacquard profile 41 is woven from high-elastic yarn using a jacquard comb through the second jacquard basic structure 1-0/1-0/1-2/1-2//, while the jacquard protrusion 42 is woven from low-elastic yarn using a jacquard comb through the first jacquard basic structure 1-0/1-1/1-2/1-1// or 1-1/1-2/1-1/1-0//.

Embodiment 2

This embodiment provides a multi-comb jacquard three-dimensional jacquard mesh fabric, including a mesh fabric body that is integrally woven by a warp knitting machine. The mesh fabric body comprises a surface layer 1, a bottom layer 2 woven below the surface layer 1, and a connection layer 3 woven between the surface layer 1 and the bottom layer 2. The surface layer 1 is knitted with the first warp knitting basic structure, the bottom layer 2 is knitted with the second warp knitting basic structure, and the connection layer 3 is used to connect the surface layer 1 and the bottom layer 2. In this embodiment, the bottom layer 2 is woven with a three-dimensional jacquard texture 4, which includes a jacquard profile 41 and a jacquard protrusion 42. The jacquard profile 41 is made from high-elastic yarn woven by the jacquard combing through the second jacquard basic structure 1-0/1-0/1-2/1-2//, while the jacquard protrusion 42 is made from low-elastic yarn woven by the jacquard combing through the first jacquard basic structure 1-0/1-1/1-2/1-1// or 1-1/1-2/1-1/1-0//.

Embodiment 3

This embodiment provides a multi-comb jacquard three-dimensional jacquard mesh fabric, including a mesh fabric body that is integrally woven by a warp knitting machine. The mesh fabric body comprises a surface layer 1, a bottom layer 2 woven below the surface layer 1, and a connection layer 3 woven between the surface layer 1 and the bottom layer 2. The surface layer 1 is knitted with the first warp knitting basic structure, the bottom layer 2 is knitted with the second warp knitting basic structure, and the connection layer 3 is used to connect the surface layer 1 and the bottom layer 2. In this case, the surface layer 1 and the bottom layer 2 are woven with a three-dimensional jacquard texture 4, which includes a jacquard profile 41 and a jacquard protrusion 42. The jacquard profile 41 is made from high-elastic yarn woven by the jacquard combing through the second jacquard basic structure 1-0/1-0/1-2/1-2//, while the jacquard protrusion 42 is made from low-elastic yarn woven by the jacquard combing through the first jacquard basic structure 1-0/1-1/1-2/1-1// or 1-1/1-2/1-1/1-0//.

Based on Embodiment 1, Embodiment 2, or Embodiment 3, it also includes: adjusting the elasticity value of the jacquard mesh fabric during the weaving of the multi-comb jacquard three-dimensional jacquard mesh fabric by selecting different proportions of yarns, which include yarns with elastic properties and yarns without elastic properties. The yarn with elastic properties referred to in this application is not limited to the material, processing technology, or structure of the yarn, as long as the corresponding yarn meets the requirements for extensibility or imparts elasticity to the mesh fabric. Common yarns include: spandex core yarn, semi-gloss environmentally friendly low-elastic lightweight mesh yarn, PTT yarn, biobased elastic yarn, PTT blended yarn, TPEE blended yarn, etc.

Optionally, the jacquard protrusion 42 is divided into several protrusion areas, with different thicknesses for the jacquard protrusions 42 in different protrusion areas, which can be arranged continuously or intermittently adjacent to each other.

Optionally, the jacquard protrusion 42 includes at least two colors, divided into first color jacquard protrusion and second color jacquard protrusion, with the multi-comb jacquard three-dimensional jacquard mesh fabric containing the first color jacquard protrusion and second color jacquard protrusion being woven from at least three jacquard combs.

Optional: the thickness variation direction of the protrusion area can be either gradually increasing from the inside out or gradually increasing from the outside in, with the thickness variation direction being horizontal and/or vertical.

Optional: the upper made of multi-comb jacquard three-dimensional jacquard mesh fabric can have at least one position selected for weaving elastic property yarns at the shoe side, shoe opening, or heel.

Optional: the upper made of multi-comb jacquard three-dimensional jacquard mesh fabric can customize elastic regions and non-elastic regions by selecting yarns and/or basic organizational structures.

Optional: the upper made of multi-comb jacquard three-dimensional jacquard mesh fabric forms a support framework through jacquard protrusions 42, which is woven from non-elastic property yarns.

Optionally, the jacquard protrusions in the first area are jacquard protrusions with different luster and brightness, including transparent convex, glossy convex, dull convex, non-glossy convex, or luster degree convex.

As shown in FIG. 4, FIG. 4 provides a simplified illustration of the jacquard protrusions 42 set on the surface layer 1, specifically, the outer jacquard protrusions 42 are thinner than the inner jacquard protrusions 42. As shown in FIG. 5, FIG. 5 provides a simplified illustration of the jacquard protrusions 42 set on the surface layer 1, specifically, the thickness of the jacquard protrusions 42 in different protrusion areas varies, with different protrusion areas arranged with adjacent spacing.

Taking the multi-comb jacquard three-dimensional jacquard mesh fabric as an example for the upper material, the overall structure of the upper material includes the structure of the aforementioned multi-comb jacquard three-dimensional jacquard mesh fabric, referred to as jacquard upper material, such as: setting jacquard protrusion structure 42 on the jacquard upper material.

Next, taking the application direction of jacquard upper material as an example, firstly, elastic customization can be performed for different areas of the upper, that is, at least one position can be selected for weaving elastic property yarn in the shoe side, shoe opening, and heel positions of the upper to change the elastic properties of the upper at the corresponding positions; Alternatively, yarn with inelastic properties can be chosen to lock the elasticity of the corresponding area, thereby restricting the elasticity of that area; Alternatively, elastic and/or inelastic yarns may be arranged in the upper area not specified above to meet daily life needs, sports, prevent ankle sprains, and replace the structures originally included in the shoe body. Among these, the replacement of the structures originally included in the shoe body includes weaving a jacquard protrusion 42 in the heel area to replace the original sponge in the heel.

Furthermore, the height of the jacquard protrusion 42 on the upper can be customized. A single upper fabric can have jacquard protrusions 42 set at multiple locations, or a large area can be set with jacquard protrusions 42, or small localized areas can have jacquard protrusions 42, or the jacquard protrusions 42 in the same area can continuously vary in thickness, or the jacquard protrusions 42 in different areas of the upper can present a layered transition, such as: jacquard protrusion 422 mm in the first area, jacquard protrusion 423 mm in the second area, and jacquard protrusion 425 mm in the third area.

Finally, customized weaving patterns, plaids, and other jacquard structures can be tailored for the non-jacquard protruding areas on the upper, or alternatively, the bottom can have no holes, regular holes, or customized holes. The size, length, and shape of the holes created for customization can all be tailored.

To achieve customized holes, at least three jacquards are required, while regular holes can be achieved with two jacquards.

Below are examples of six types of jacquard upper fabrics. The first type includes: jacquard protrusion 42, with holes opened or not opened on the jacquard protrusion 42, and patterns set on the non-jacquard protruding areas of the upper, selectively establishing corresponding structures on the surface layer 1 and bottom layer 2, with uppers woven with more than 32 needles resulting in a finer texture. In the second option, the bottom layer 2 does not have holes, or has holes in a regular pattern, while the surface layer 1 has jacquard protrusions with either 42 holes or no holes; In the third option, jacquard protrusions 42 are set on the upper, with free holes or jacquard on the jacquard protrusions 42, and non-jacquard protruding parts can also be jacquard or have holes; In the fourth option, the subsequent changes of jacquard protrusions 42 on the upper are gradual, with no restrictions on the gradient direction of jacquard protrusions 42. It can gradually change towards the center from both sides, or from the center towards both sides, or from the top and bottom towards the center, or from the center towards the top and bottom. The gradient can be continuous or discontinuous; The fifth type features a two-color jacquard protrusion 42 on the upper, taking the red and blue jacquard protrusions 42 as examples, where the upper can have several red jacquard protrusions 42 and blue jacquard protrusions 42. The sixth type has gradient jacquard protrusions 42 on the upper, with holes potentially opened on the protrusions, while free holes can be made on non-jacquard protrusions; the bottom layer 2 does not allow free holes, but can have regular holes. Among the six types of jacquard upper fabrics, the third, fifth, and sixth types require at least three Jacquard machines to achieve, while the other upper fabrics require at least a double Jacquard machine.

Embodiment 4

This embodiment provides a preparation method for a multi-comb jacquard three-dimensional jacquard mesh fabric, including:

S1. Combing Setting Step

Using a high-speed double Jacquard machine with a double needle bed for weaving, the high-speed double Jacquard machine with a double needle bed is equipped with at least 8 combs, which are sequentially arranged from the front needle bed to the rear needle bed as follows: ground comb GB1, ground comb GB2, jacquard comb JK1.1, jacquard comb JK1.2, jacquard comb JK2.1, jacquard comb JK2.2, ground comb GB7, and ground comb GB8.

S2. Warping Steps

Ground comb GB1 warping P-DTY75D/36F semi-gloss environmentally friendly low elasticity light mesh (recycle) yarn with 6 bobbin heads, each containing 512 strands; P-DTY75D/36F semi-gloss environmentally friendly low elasticity light mesh (recycle) accounts for 10.299%%.

Ground comb GB2 warping P-DT30D/1F environmentally friendly monofilament semi-gloss yarn with 6 bobbin heads, each containing 512 strands; P-DT30D/1F environmentally friendly monofilament semi-gloss yarn accounts for 10.4731% %.

Jacquard Combing JK1.1 warping P-DTY150D/48F semi-gloss environmentally friendly low elasticity light mesh (recycle) yarn with 6 bobbin heads, each containing 256 strands; P-DTY150D/48F semi-gloss environmentally friendly low elasticity light mesh (recycle) accounts for 15.605%%.

Jacquard Combing JK1.2 warping P-DTY150D/48F semi-gloss environmentally friendly low elasticity light mesh (recycle) yarn with 6 bobbin heads, each containing 256 strands of yarn; the P-DTY150D/48F semi-gloss environmentally friendly low elasticity light mesh (recycle) content accounts for 15.605%.

Jacquard Combing JK2.1 warping SCY-70D/70D/24F nylon white high-elastic spandex core yarn with 6 bobbin heads, each containing 256 strands of yarn; the SCY-70D/70D/24F nylon white high-elastic spandex core yarn content accounts for 10.333%.

Jacquard Combing JK2.2 warping SCY-70D/70D/24F nylon white high-elastic spandex core yarn with 6 bobbin heads, each containing 256 strands of yarn; the SCY-70D/70D/24F nylon white high-elastic spandex core yarn content accounts for 10.333%.

Ground comb GB7 warping P-DTY75D/36F semi-gloss environmental protection low elasticity light mesh (recycle) yarn with 6 bobbin heads, each containing 512 yarns; P-DTY75D/36F semi-gloss environmental protection low elasticity light mesh (recycle) content accounts for 10.611%.

Ground comb GB8 warping P-DTY75D/36F semi-gloss environmental protection low elasticity light mesh (recycle) yarn with 6 bobbin heads, each containing 512 yarns; P-DTY75D/36F semi-gloss environmental protection low elasticity light mesh (recycle) content accounts for 12.481%.

S3. Yarn Threading Steps

Both Ground comb GB1 and Ground comb GB2 are threaded in a full threading manner on the high-speed double Jacquard machine with double needle bed; Jacquard comb JK1.1, Jacquard comb JK1.2, Jacquard comb JK2.1, and Jacquard comb JK2.2 are threaded in a one-in-one-out manner on the high-speed double Jacquard machine with double needle bed; Ground comb GB7 and Ground comb GB8 are threaded in a full threading manner on the high-speed double Jacquard machine with double needle bed.

The gear feeding amount corresponding to the ground comb GB1 is 1650 mm/lack, the gear feeding amount corresponding to the ground comb GB2 is 5900 mm/lack, the gear feeding amount corresponding to the Jacquard comb JK1.1 is 2500 mm/lack, the gear feeding amount corresponding to the Jacquard comb JK1.2 is 2500 mm/lack, the gear feeding amount corresponding to the Jacquard comb JK2.1 is 2670 mm/lack, the gear feeding amount corresponding to the Jacquard comb JK2.2 is 2670 mm/lack, the gear feeding amount corresponding to the ground comb GB7 is 1700 mm/lack, and the gear feeding amount corresponding to the ground comb GB8 is 2000 mm/lack.

S4. Knitting Steps

Ground comb GB1 is on the front needle bed and follows the basic structure of warp knitting 1-0/0-0/0-1/1-1//, while ground comb GB2 is on the front needle bed and follows the basic structure of warp knitting 1-0/0-1/1-0/0-1//, forming surface layer 1.

Jacquard comb JK1.1 and Jacquard comb JK1.2 are both on the front needle bed and follow the Jacquard basic structure 1-0/1-1/1-2/1-1//, forming Jacquard protrusion 42.

Jacquard comb JK2.1 and Jacquard comb JK2.2 are both on the front needle bed and rear needle bed and follow the Jacquard basic structure 1-0/1-0/1-2/1-2//, forming Jacquard profile 41.

Ground comb GB7 is on the rear needle bed with yarn and follows the basic structure of warp knitting 1-1/0-1/1-1/2-1//, while ground comb GB8 is on the rear needle bed with yarn and follows the basic structure of warp knitting 2-2/3-2/1-1/0-1//, forming the bottom layer 2.

Embodiment 5

This embodiment provides a preparation method for a multi-comb jacquard three-dimensional jacquard mesh fabric, including:

S1. Combing Setting Step

Using a high-speed double Jacquard machine with a double needle bed for weaving, the high-speed double Jacquard machine with a double needle bed is equipped with at least 8 combs, which are sequentially arranged from the front needle bed to the rear needle bed as follows: ground comb GB1, ground comb GB2, jacquard comb JK1.1, jacquard comb JK1.2, jacquard comb JK2.1, jacquard comb JK2.2, ground comb GB7, and ground comb GB8.

S2. Warping Steps

Ground comb GB1 warping P-DTY75D/36F semi-gloss environmentally friendly low elasticity light mesh (recycle) yarn with 6 bobbin heads, each containing 512 yarns, where the content of P-DTY75D/36F semi-gloss environmentally friendly low elasticity light mesh (recycle) accounts for 8.913%.

Ground comb GB2 warping P-DT30D/1FCD environmental protection monofilament semi-gloss yarn with 6 bobbin heads, each bobbin head containing 512 yarns; P-DT30D/1F environmental protection monofilament semi-gloss yarn accounts for 12.583%.

Jacquard Combing JK1.1 warping P-DTY150D/48F semi-gloss environmental protection low elasticity light mesh (recycle) yarn with 6 bobbin heads, each bobbin head containing 256 yarns; P-DTY150D/48F semi-gloss environmental protection low elasticity light mesh (recycle) accounts for 13.632%.

Jacquard Combing JK1.2 warping P-DTY150D/48F semi-gloss environmental protection low elasticity light mesh (recycle) yarn with 6 bobbin heads, each bobbin head containing 256 yarns; P-DTY150D/48F semi-gloss environmental protection low elasticity light mesh (recycle) accounts for 13.632%.

Jacquard comb JK2.1 warping SCY-70D/75D/36F CD high-elastic spandex core yarn with 6 bobbin heads, each containing 256 yarns; SCY-70D/70D/24F CD high-elastic spandex core yarn with a content of 8.842%.

Jacquard comb JK2.2 warping SCY-70D/70D/24F nylon white high-elastic spandex core yarn with 6 bobbin heads, each containing 256 yarns; SCY-70D/70D/24F nylon white high-elastic spandex core yarn with a content of 10.333%.

Ground comb GB7 warping P-DTY200D/96F semi-gloss environmentally friendly low elasticity light mesh (recycle) yarn with 6 bobbin heads, each bobbin head containing 256 yarns; P-DTY200D/96F semi-gloss environmentally friendly low elasticity light mesh (recycle) content accounts for 16.778%.

Ground comb GB8 warping P-DTY200D/96F CD semi-gloss environmentally friendly low elasticity light mesh (recycle) yarn with 6 bobbin heads, each bobbin head containing 256 yarns; P-DTY200D/96F semi-gloss CD environmentally friendly low elasticity light mesh (recycle) content accounts for 16.778%.

S3. Yarn Threading Steps

Ground comb GB1 and Ground comb GB2 are both threaded in a full-threading manner on the high-speed double Jacquard machine with double needle bed. Jacquard comb JK1.1, Jacquard comb JK1.2, Jacquard comb JK2.1, and Jacquard comb JK2.2 are all threaded in a 1 thread 1 skip manner on the high-speed double Jacquard machine with double needle bed. Ground comb GB7 and Ground comb GB8 are both threaded in a 2 threads 2 skips manner on the high-speed double Jacquard machine with double needle bed.

The gear feed amount corresponding to the ground comb GB1 is 1700 mm/lac, the gear feed amount corresponding to the ground comb GB2 is 6000 mm/lac, the gear feed amount corresponding to the Jacquard comb JK1.1 is 2600 mm/lac, the gear feed amount corresponding to the Jacquard comb JK1.2 is 2600 mm/lac, the gear feed amount corresponding to the Jacquard comb JK2.1 is 2720 mm/lac, the gear feed amount corresponding to the Jacquard comb JK2.2 is 2720 mm/lac, the gear feed amount corresponding to the ground comb GB7 is 2400 mm/lac, and the gear feed amount corresponding to the ground comb GB8 is 2400 mm/lac.

S4. Knitting Steps

Ground comb GB1 is on the front needle bed and follows the basic structure of warp knitting 1-0/0-0/0-1/1-1//, while ground comb GB2 is on the front needle bed and follows the basic structure of warp knitting 1-0/0-1/1-0/0-1//, forming surface layer 1.

Jacquard comb JK1.1 and Jacquard comb JK1.2 are both on the front needle bed and follow the Jacquard basic structure 1-0/1-1/1-2/1-1//, forming Jacquard protrusion 42.

Jacquard comb JK2.1 and Jacquard comb JK2.2 are both on the front needle bed and rear needle bed and follow the Jacquard basic structure 1-0/1-0/1-2/1-2//, forming Jacquard profile 41;

Ground comb GB7 is on the rear needle bed with yarn and follows the basic structure of warp knitting 1-1/1-0/1-1/2-3/2-2/1-0/2-2/4-5/4-4/3-2/3-3/4-5//, while ground comb GB8 is on the rear needle bed with yarn and follows the basic structure of warp knitting 2-2/4-5/4-4/3-2/3-3/4-5/3-3/1-0/1-1/2-3/2-2/1-0//, forming the bottom layer 2.

Embodiment 6

This embodiment provides a preparation method for a multi-comb jacquard three-dimensional jacquard mesh fabric, including:

S1. Combing Setting Step

Using a double needle bed high-speed three Jacquard machine for weaving, the double needle bed high-speed three Jacquard machine is equipped with at least 9 combs, which are arranged from the front needle bed to the rear needle bed as follows: ground comb GB1, ground comb GB2, Jacquard comb JK1.1, Jacquard comb JK1.2, Jacquard comb JK2.1, Jacquard comb JK2.2, Jacquard comb JK3.1, Jacquard comb JK3.2, and ground comb GB9.

S2. Warping Steps

Ground comb GB1 warping P-DTY100D/48F semi-gloss environmentally friendly low elasticity light mesh (recycle) yarn with 6 bobbin heads, each containing 512 strands of yarn; P-DTY100D/48F semi-gloss environmentally friendly low elasticity light mesh (recycle) yarn accounts for 9.493%.

Ground comb GB2 warping P-DT30D/1F environmentally friendly monofilament semi-gloss yarn with 6 bobbin heads, each containing 512 strands of yarn; P-DT30D/1F environmentally friendly monofilament semi-gloss yarn accounts for 13.577%.

Jacquard Combing JK1.1 warping P-DTY150D/48F semi-gloss environmentally friendly low elasticity light mesh (recycle) yarn with 6 bobbin heads, each containing 256 strands of yarn; P-DTY150D/48F semi-gloss environmentally friendly low elasticity light mesh (recycle) accounts for 14.383%.

Jacquard Combing JK1.2 warping P-DTY150D/48F semi-gloss environmentally friendly low elasticity light mesh (recycle) yarn with 6 bobbin heads, each containing 256 yarns; P-DTY150D/48F semi-gloss environmentally friendly low elasticity light mesh (recycle) content accounts for 14.383%.

Jacquard Combing JK2.1 warping SCY-70D/75D/36F nylon white high-elastic spandex core yarn with 6 bobbin heads, each containing 256 yarns; SCY-70D/70D/24F nylon white high-elastic spandex core yarn content accounts for 9.524%.

Jacquard Combing JK2.2 warping SCY-70D/70D/24F nylon white high-elastic spandex core yarn with 6 bobbin heads, each containing 256 yarns; SCY-70D/70D/24F nylon white high-elastic spandex core yarn content accounts for 9.524%.

Jacquard Combing JK3.1 Warping P-FDY150D/36F Semi-gloss (biodegradable) yarn with 6 bobbin heads, each containing 256 strands of yarn; P-FDY150D/36F Semi-gloss (biodegradable) content accounts for 7.847%.

Jacquard Combing JK3.2 Warping P-FDY150D/36F Semi-gloss (biodegradable) yarn with 6 bobbin heads, each containing 256 strands of yarn; P-FDY150D/36F Semi-gloss (biodegradable) content accounts for 7.847%.

Ground Combing GB9 Warping P-DTY100D/48F Semi-gloss environmentally friendly low elasticity light mesh (recycle) yarn with 6 bobbin heads, each containing 512 strands of yarn; P-DTY100D/48F Semi-gloss environmentally friendly low elasticity light mesh (recycle) yarn content accounts for 13.424%.

S3. Yarn Threading Steps

Both Ground comb GB1 and Ground comb GB2 are threaded using a full threading method on the high-speed double Jacquard machine with double needle bed. Jacquard comb JK1.1, Jacquard comb JK1.2, Jacquard comb JK2.1, Jacquard comb JK2.2, Jacquard comb JK3.1, and Jacquard comb JK3.2 are all threaded using a 1 thread 1 empty method on the high-speed double Jacquard machine with double needle bed; Ground comb GB9 is threaded using a full threading method on the high-speed double Jacquard machine with double needle bed.

The gear feed length corresponding to the ground comb GB1 is 1720 mm/lack, the gear feed length corresponding to the ground comb GB2 is 5900 mm/lack, the gear feed length corresponding to the Jacquard comb JK1.1 is 2500 mm/lack, the gear feed length corresponding to the Jacquard comb JK1.2 is 2500 mm/lack, the gear feed length corresponding to the Jacquard comb JK2.1 is 2670 mm/lack, the gear feed length corresponding to the Jacquard comb JK2.2 is 2670 mm/lack, the gear feed length corresponding to the Jacquard comb JK3.1 is 2200 mm/lack, the gear feed length corresponding to the Jacquard comb JK3.2 is 2200 mm/lack, and the gear feed length corresponding to the ground comb GB9 is 1750 mm/lack.

S4. Knitting Steps

Ground comb GB1 is on the front needle bed and follows the basic structure of warp knitting 1-0/0-0/0-1/1-1//, while ground comb GB2 is on the front needle bed and follows the basic structure of warp knitting 1-0/0-1/1-0/0-1//, forming surface layer 1.

Jacquard comb JK1.1 and Jacquard comb JK1.2 are both on the front needle bed and follow the Jacquard basic structure 1-0/1-1/1-2/1-1//, forming Jacquard protrusion 42.

Jacquard comb JK2.1 and Jacquard comb JK2.2 are both on the front needle bed and rear needle bed and follow the Jacquard basic structure 1-0/1-0/1-2/1-2//, forming Jacquard profile 41.

Jacquard comb JK3.1 and Jacquard comb JK3.2 are both on the rear needle bed with yarn and follow the Jacquard basic structure 1-1/1-2/1-1/1-0//, forming a Jacquard protrusion 42.

Ground comb GB9 is on the rear needle bed with yarn and follows the basic structure of warp knitting 1-1/1-0/0-0/0-1//, forming the bottom layer 2.

Embodiment 7

This embodiment provides a preparation method for a multi-comb jacquard three-dimensional jacquard mesh fabric, including:

S1. Combing Setting Step

Using a high-speed double Jacquard machine with a double needle bed for weaving, the high-speed double Jacquard machine with a double needle bed is equipped with at least 8 combs, which are sequentially arranged from the front needle bed to the rear needle bed as follows: ground comb GB1, ground comb GB2, jacquard comb JK1.1, jacquard comb JK1.2, jacquard comb JK2.1, jacquard comb JK2.2, ground comb GB7, and ground comb GB8.

S2. Warping Steps

Ground comb GB1 warping P-DTY100D/48F semi-gloss low elasticity light mesh (recycle) yarn with 6 bobbin heads, each containing 512 yarns, P-DTY100D/48F semi-gloss low elasticity light mesh (recycle) accounts for 13.053%.

Ground comb GB2 warping P-DT30D/1FCD single filament semi-gloss yarn with 6 bobbin heads, each containing 512 yarns; P-DT30D/1F single filament semi-gloss yarn accounts for 13.970%.

Jacquard Combing JK1.1 warping P-DTY150D/48F semi-gloss low elasticity light mesh gradient dyed yarn (UV blue/fluorescent yellow/lightning red/lemon green) yarn rack, 1536 yarns; P-DTY150D/48F semi-gloss low elasticity light mesh gradient dyed yarn (UV blue/fluorescent yellow/lightning red/lemon green) yarn rack accounts for 14.658%.

Jacquard Combing JK1.2 warping P-DTY150D/48F semi-gloss low elasticity light mesh gradient dyed yarn (Ultraviolet Blue/Fluorescent Yellow/Lightning Red/Lemon Green) yarn frame yarn, 1536 strands of yarn, P-DTY150D/48F semi-gloss low elasticity light mesh gradient dyed yarn (Ultraviolet Blue/Fluorescent Yellow/Lightning Red/Lemon Green) yarn frame yarn content accounts for 14.658%.

Jacquard Combing JK2.1 warping SCY-70D/100D/48F iridescent high-elastic spandex core yarn frame yarn, 1536 strands of yarn, SCY-70D/100D/48F iridescent high-elastic spandex core-spun yarn frame yarn content accounts for 10.631%.

Jacquard Combing JK2.2 warping SCY-70D/100D/48F iridescent white high-elastic polyurethane covered yarn, 1536 yarns, SCY-70D/100D/48F iridescent high-elastic polyurethane covered yarn accounts for 10.631%.

Ground comb GB7 warping TPEE-DT0.10/1F transparent glossy monofilament (100D/1F) yarn 6 bobbin heads with 387 yarns each, TPEE-DT0.10/1F transparent glossy monofilament (100D/1F) accounts for 11.199%.

Ground comb GB8 warping TPEE-DT0.10/1F transparent glossy monofilament (100D/1F) yarn 6 bobbin heads with 387 yarns each, TPEE-DT0.10/1F transparent glossy monofilament (100D/1F) accounts for 11.199%.

S3. Yarn Threading Steps

The ground comb GB1 and ground comb GB2 are both threaded using a full threading method on the high-speed double Jacquard machine with double needle bed. The Jacquard combs JK1.1, JK1.2, JK2.1, and JK2.2 are threaded using a 1 thread 1 skip method on the high-speed double Jacquard machine with double needle bed, while the ground combs GB7 and GB8 are threaded using a 3 thread 1 skip method on the high-speed double Jacquard machine with double needle bed.

The gear feed length for ground comb GB1 is 1850 mm/lock, for ground comb GB2 is 6600 mm/lock, for Jacquard comb JK1.1 is 2770 mm/lock, for Jacquard comb JK1.2 is 2770 mm/lock, for Jacquard comb JK2.1 is 2450 mm/lock, for Jacquard comb JK2.2 is 2450 mm/lock, for ground comb GB7 is 2100 mm/lock, and for ground comb GB8 is 2100 mm/lock.

S4. Knitting Steps

Ground comb GB1 is on the front needle bed and follows the basic structure of warp knitting 1-0/0-0/0-1/1-1//, while ground comb GB2 is on the front needle bed and follows the basic structure of warp knitting 1-0/0-1/1-0/0-1//, forming surface layer 1.

Both Jacquard Combing JK1.1 and Jacquard Combing JK1.2 are on the front needle bed with yarn and follow the Jacquard basic structure 1-0/2-2/1-2/1-1//, forming a Jacquard protrusion of 42.

Jacquard comb JK2.1 and Jacquard comb JK2.2 are both on the front needle bed and rear needle bed and follow the Jacquard basic structure 1-0/1-0/1-2/1-2//, forming Jacquard profile 41.

Ground comb GB7 is on the rear needle bed with yarn and follows the basic structure of warp knitting (1-1/1-0/1-1/1-2)*2/(2-2/3-4/3-3/3-2)*2//, while ground comb GB8 is on the rear needle bed with yarn and follows the basic structure of warp knitting (3-3/3-4/3-3/3-2)*2/(1-1/1-0/1-1/1-2)*2//, forming a bottom layer of 2.

It should be understood that the embodiments disclosed in this application are not limited to the specific processing steps or materials disclosed here, but should extend to equivalent alternatives of such features as understood by those skilled in the relevant field. It should also be understood that the terminology used herein is for the purpose of describing specific embodiments only and does not imply any limitation.

The term 'embodiment' mentioned in the specification refers to specific features or characteristics described in conjunction with the embodiments, which are included in at least one embodiment of this application. Therefore, the phrases or 'embodiments' appearing throughout the specification do not necessarily refer to the same embodiment.

In addition, the features or characteristics described may be combined in any other suitable manner into one or more embodiments. In the above description, specific details such as thickness, quantity, etc., are provided to give a comprehensive understanding of the embodiments of the present invention. However, those skilled in the relevant field will understand that the present invention can be realized without one or more of the specific details mentioned above, or can be implemented using other methods, components, materials, etc.

What is claimed is:

1. A multi-comb Jacquard three-dimensional jacquard mesh fabric, comprising a mesh fabric body that is integrally woven by a warp knitting machine, wherein the mesh fabric body includes:

a surface layer, which is woven with the first warp knitting basic structure;

a base layer, which is woven with the second warp knitting basic structure; and a connecting layer, which is woven between the surface layer and the base layer and is used to connect the surface layer and the base layer;

wherein, the surface layer and/or the base layer is woven with a three-dimensional jacquard pattern, the three-dimensional jacquard pattern includes a jacquard profile and jacquard protrusions, the jacquard profile is woven by the Jacquard comb through the second Jacquard basic structure, the jacquard protrusions are woven by the Jacquard comb through the first Jacquard basic structure, the jacquard mesh fabric has the jacquard protrusions in the first area, while the rest is in the second area, a thickness of the first area is greater than that of the second area, the first area is woven with jacquard and/or mesh, and the second area is woven with jacquard and/or mesh.

2. The multi-comb Jacquard three-dimensional jacquard mesh fabric according to claim 1, wherein an elastic value of the jacquard mesh fabric is adjusted by selecting different proportions of yarns during weaving, the yarns include those with elastic properties and those without elastic properties.

3. The multi-comb Jacquard three-dimensional jacquard mesh fabric according to claim 1, wherein the jacquard protrusions are divided into several protrusion areas, with different thicknesses of the jacquard protrusions in different protrusion areas, and the different protrusion areas are arranged either adjacent and continuous or spaced apart.

4. The multi-comb Jacquard three-dimensional jacquard mesh fabric according to claim 1, wherein the jacquard protrusions include at least two colors, and are divided into first color jacquard protrusions and second color jacquard protrusions, the multi-comb Jacquard three-dimensional jacquard mesh fabric containing the first color jacquard protrusions and the second color jacquard protrusions is woven using at least three Jacquard combs.

5. The multi-comb Jacquard three-dimensional jacquard mesh fabric according to claim 1, wherein the thickness variation direction of the protruding areas is gradually increasing from the inside to the outside or gradually increasing from the outside to the inside, and the thickness variation direction is either transverse and/or longitudinal, wherein the inside and the outside are defined relative to a center of each protruding area.

6. The multi-comb Jacquard three-dimensional jacquard mesh fabric according to claim 1, wherein the multi-comb Jacquard three-dimensional jacquard mesh fabric is made into an upper, and at least one position of the shoe side, shoe opening, or shoe heel is selected to weave yarn with elastic properties.

7. The multi-comb Jacquard three-dimensional jacquard mesh fabric according to claim 1, wherein the multi-comb Jacquard three-dimensional jacquard mesh fabric is made into an upper, and the upper customizes elastic areas and non-elastic areas by selecting yarn and/or basic organizational structure.

8. The multi-comb Jacquard three-dimensional jacquard mesh fabric according to claim 1, wherein the multi-comb Jacquard three-dimensional jacquard mesh fabric is made into an upper, and a supporting framework is formed on the upper through jacquard protrusions, which is woven from yarn without elastic properties.

9. The multi-comb Jacquard three-dimensional jacquard mesh fabric according to claim 1, wherein the jacquard protrusions in the first area have different luster and brightness, and the jacquard protrusions with different luster and brightness include transparent protrusions, glossy protrusions, matte protrusions, non-glossy protrusions, or luster protrusions, with the base layer woven with breathable holes.

10. A preparation method for a multi-comb Jacquard three-dimensional jacquard mesh fabric, comprising using a double needle bed Jacquard warp knitting machine for fabric weaving, the fabric includes:

a surface layer, which is at least woven with one ground comb, where the ground comb lays yarn on the front needle bed and follows the first warp knitting basic structure;

a base layer, which is at least woven with one ground comb, where the ground comb lays yarn on the back needle bed and follows the second warp knitting basic structure;

a connecting layer, which is at least woven with one Jacquard comb or one ground comb, where the Jacquard comb lays yarn on both the front and back needle beds;

wherein among them, the surface layer and/or the base layer is woven with a three-dimensional jacquard pattern, which includes a jacquard profile and jacquard protrusions; the jacquard profile is at least woven with one Jacquard comb, and the Jacquard comb is placed on the front needle bed and/or the back needle bed while following the first Jacquard basic structure; the jacquard protrusions are at least woven with one Jacquard comb, and the Jacquard comb is placed on the front needle bed and/or the back needle bed while following the second Jacquard basic structure.

* * * * *